United States Patent [19]

Hildebrandt

[11] 4,222,525

[45] Sep. 16, 1980

[54] ARRANGEMENT FOR SPRAYING LIQUID FROM A BOTTLE

[75] Inventor: Bodo Hildebrandt, Rhönring, Fed. Rep. of Germany

[73] Assignee: Wella Aktiengesellschaft, Darmstadt, Fed. Rep. of Germany

[21] Appl. No.: 914,941

[22] Filed: Jun. 12, 1978

[30] Foreign Application Priority Data

Jun. 25, 1977 [DE] Fed. Rep. of Germany ..... 2728683

[51] Int. Cl.[2] ..... B05B 7/32

[52] U.S. Cl. ..... 239/343; 222/401; 222/468; 222/470; 239/346; 239/348; 239/351; 239/366; 239/370

[58] Field of Search ..... 239/343, 346, 347, 348, 239/351, 365–370, 307, 308; 222/400.8, 401, 397, 468, 470

[56] References Cited

U.S. PATENT DOCUMENTS

| | | | |
|---|---|---|---|
| 1,457,895 | 6/1923 | Campanella | 239/343 |
| 2,310,633 | 2/1943 | Heimburger | 239/369 |
| 2,517,961 | 8/1950 | Baron | 239/368 |
| 2,651,546 | 9/1953 | Palm | 239/343 |
| 3,451,596 | 6/1969 | Marand | 239/308 |
| 3,465,469 | 9/1969 | Winter et al. | 239/351 |
| 4,033,511 | 7/1977 | Chamberlin | 239/346 |

FOREIGN PATENT DOCUMENTS

| | | | |
|---|---|---|---|
| 110465 | 5/1940 | Australia | 239/348 |

*Primary Examiner*—Robert B. Reeves
*Assistant Examiner*—Michael J. Forman
*Attorney, Agent, or Firm*—Michael J. Striker

[57] ABSTRACT

An arrangement for spraying liquid from a bottle comprises an air pump and a member which actuates the pump when a spraying action is desirable. The air flow is transmitted into the interior of the bottle to pressurize the liquid and urge the latter into a liquid outlet conduit which has a lower end extending into the liquid in the bottle and a discharge end outside the bottle. The arrangement is further provided with an element for spraying the liquid when the latter under the pressure supplied into the bottle enters the discharge end of the outlet conduit.

26 Claims, 5 Drawing Figures

ARRANGEMENT FOR SPRAYING LIQUID FROM A BOTTLE

BACKGROUND OF THE INVENTION

The present invention relates to an arrangement for spraying.

More particularly, the present invention concerns an arrangement for spraying liquid from a bottle.

Arrangements of this type have already been proposed and are usually known as atomizers. Such arrangements deal with different types of liquid, e.g., different types of hair cosmetics, skin cosmetics or medications, and are becoming more and more important as a replacement for aerosols whose use is being curtailed in view of the finding that they may be harmful to the ozone layer of the earth.

An arrangement for spraying cosmetic preparation has been disclosed for example in German allowed application No. 25 21 694. According to this, a bottle, which contains preparation to be sprayed, is threaded onto a carrying arm so that, when the contents of the bottle are used up, the empty bottle can be replaced by a new full bottle. This arrangement has a shortcoming, in that the utilization of the following bottle in such a succession of interchangeable bottles is not always possible without additional cleansing of the elements which constitute the arrangement. This is especially essential in a situation where successive bottles contain different preparations which are not compatible with each other. Such a situation can occur, for example, when different preparations are of different colors or odors, or when two preparations which are to be used successively can create undesirable chemical reactions or produce some undesirable by-products when reacting with one another. Such situations are very likely to occur because the preparations run through the same passages or chambers all the way to the spraying nozzle.

To eliminate this shortcoming, it is known in the art (see German Offenlegungsschrift No. 14 75 170) to provide an arrangement which renders it possible to replace the bottle alone or together with an adapter having a nozzle. However, this also has disadvantages and a better solution to the problem is desirable.

SUMMARY OF THE INVENTION

It is a general object of the present invention to provide an arrangement for spraying liquid from a bottle which avoids the disadvantages of the prior art arrangements.

More particularly, it is an object of the present invention to provide a manually operable arrangement for spraying liquids such as e.g., cosmetic preparations, of such a construction which makes it possible to considerably facilitate manipulations of the arrangement.

A further object of the present invention resides in providing an arrangement for spraying liquid preparations which renders it possible to change the adapter together with the bottle containing the liquid to be sprayed.

In keeping with these objects and with others which will become apparent hereafter, one feature of the present invention resides, briefly stated, in an arrangement for spraying liquid from a bottle, which arrangement comprises a piston pump, means for actuating the pump, air inlet means for operatively connecting the pump with the interior of the bottle for supplying air into the bottle when the pump is actuated to thereby pressurize the liquid.

The arrangement further comprises liquid outlet means which have a lower end extending into the liquid in the bottle and a discharge end outside the bottle.

In order to spray the liquid, the arrangement is provided with means for this purpose which are operable when the liquid under the pressure of the air supplied into the bottle enters the discharge end of the outlet means.

The air pump and the actuating means are enclosed in a housing which is connected to the bottle via an adapter which is provided with the spraying means.

The adapter is provided with a first passage for connecting the air inlet means with the interior of the bottle, a spraying nozzle and a second passage connecting the liquid outlet means with the spraying nozzle. The adapter is further provided with a third passage operative for connecting the first passage with the spraying nozzle.

Such a constructive feature is advantageous because it renders it unnecessary to adjust the pressure of the air in accordance with the viscosity of different preparations. This requirement is met by provision of the spraying nozzle which is rigidly connected with the bottle containing the liquid.

Moreover, the pressure created in first passage which connects the air inlet means with the interior of the housing, is distributed partially to the container and partially to the spraying nozzle, and therefore less pressure is required from the air pump for accomplishing the spraying action in comparison with known spraying heads.

Provision of the bottle and the spraying nozzle in one unit and connection of such a unit to the air inlet means, renders it possible to spend much less time on the replacement of such a unit when for example the bottle is empty. Inasmuch as no preparation has any contact with another, there is no problem about the possible incompatibility of the different preparations.

According to another advantageous feature of the present invention, the arrangement is provided with a hand-operated actuator which has a portion engageable during displacement of the actuators with an end stop (e.g., microswitch) connected to a motor which is coupled with the air pump. On the other hand the actuator is provided with a pin which is located adjacent to a pressure release valve. The actuator, on its movements from a rest position to a working position, urges the pin into the pressure release valve to thereby make the air come through the valve into the interior of the bottle. The actuator is provided with a spring which urges the actuator back towards its rest position.

Provision of the pressure release valve renders possible a rapid decrease of the pressure in the air inlet means and in the bottle upon interruption of the motor current, thereby eliminating undesirable drying of the liquid, because it is well known that if the pressure decreases slowly the fine liquid particles in the nozzle have a tendency to combine and form drops. Should the actuator be suddenly released, the pressure will also decrease suddenly and this prevents unsprayed liquid residue from forming in the nozzle and clogging the same.

If it is desired to turn the liquid into froth, or for other applications, the present arrangement can be provided with a tube-shaped, preferably elastic applicator nozzle which may be relasably secured on the spray nozzle. Such an applicator nozzle is provided with one or more sieve-like partitions (spaced longitudinally from each other if more than one) spaced at some distance from the outlet of the spray nozzle of the adapter.

Thus, it is possible to optionally use the present arrangement for either spraying a liquid or for turning the liquid into a froth or foam. The present arrangement can be employed for spraying purposes when for example a small amount of liquid is to be uniformly applied to the hair of a user and when the wetting influence of the preparation, for example hair lacquers, is desired to remain uniformly for a long time period, in other words when quick volitalization of the preparation is to be prevented.

The easy installation and removal of the preferably elastic applicator nozzle renders it possible to very quickly transfer the arrangement from its spraying function to its foaming function, and back again.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
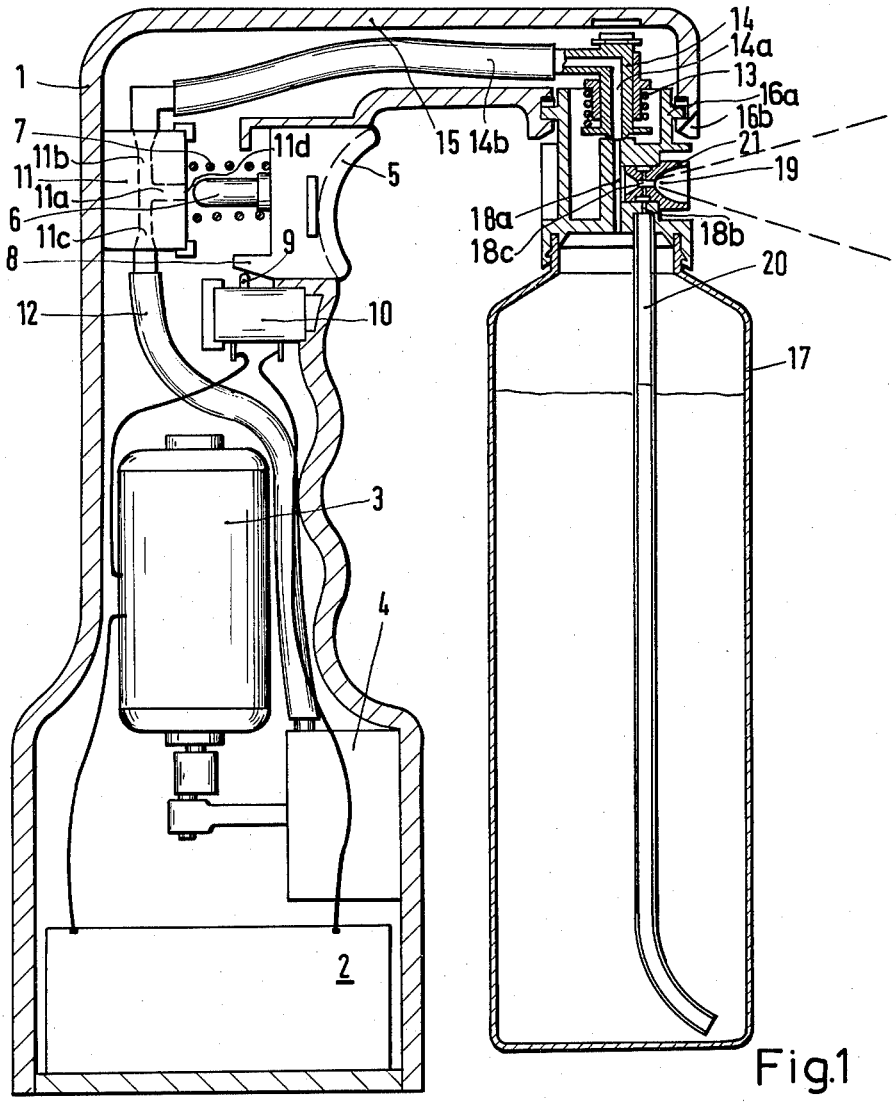
FIG. 1 is a vertical section showing an arrangement according to the invention.
Figure 2:
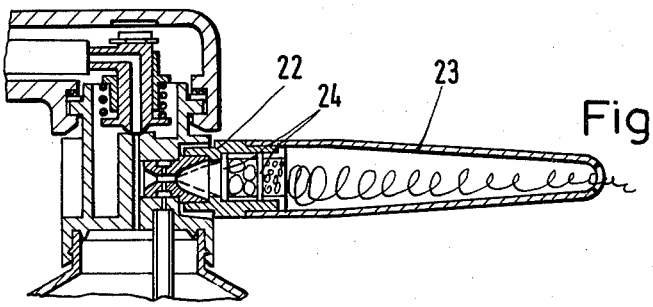
FIG. 2 is a fragmentary sectioned view, showing a detail of a further embodiment which, except for the illustrated differences, corresponds to that of FIG. 1.
Figure 3:
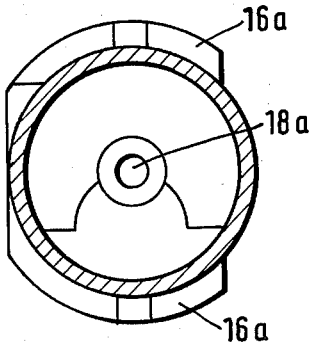
FIG. 3 shows a top view of the adaptor head.
Figure 4:
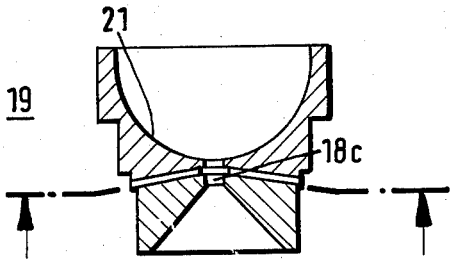
FIG. 4 shows a side cross-section of the nozzle.
Figure 5:
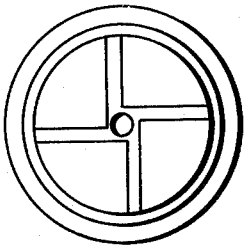
FIG. 5, shows a cross section of the nozzle at 5—5 of FIG. 4.

Referring now to FIG. 1 of the drawing, it may be seen that an arrangement for spraying liquid from a bottle 17 is identified in toto by reference numeral 1 and formed as a housing or handle which is provided in its lower portion with a battery 2 and an air pump 4 driven by a motor 3. In the upper portion of the housing 1 there is provided an actuator 5 having a pin 6 which is guided in a helical spring 7. The actuator is further provided with a projection 8 which has a tapered lower surface engaged with a plunger or actuator 9 of the microswitch 10. There is provided in the housing a pressure release valve 11, which comprises three intercommunicated passages 11*a*, 11*b*, 11*c*. The passage 11*a* is adapted to closely receive therein the pin 6. The pressure release valve 11 interconnects air supplying conduits 12 and 14*b*, which are operative to transmit air pressure from the air pump 4 towards an air pressure coupling. This coupling includes a ball end pin 14 provided with a spring 13 and a central air passage 14*a*, so that pin 14 is located in the front portion of the carrying arm 15 of the housing 1. A downwardly directed support 16*b* is an element of a bayonet lock. Two radially and outwardly extended projections 16*a* are provided on another element of the bayonet lock, that is an adaptor. The adaptor is further provided with a throughgoing passage 18*a*, a spraying nozzle 19 and a transverse passage 18*c* which connects the passage 18*a* with the nozzle 19. Another passage 18*b* connects a riser tube 20 with the nozzle 19. The tube 20 extends into the liquid contained in a bottle 17, which is fixedly connected to the adaptor. The wall of the nozzle is shaped as a parabolic discharging funnel 21. A froth creating barrel member 22 can be optionally installed on the funnel 21. The member 22 is provided with an elastic tube-shaped discharging nozzle 23. The member 22 is provided inwardly with two sieve-like partitions 24 (see FIG. 2).

The present arrangement can be further provided with a rechargeable storage battery (not shown), in view of the battery 2. In such a case the storage battery can be recharged through terminals accessible outside the housing 1.

Further, the pressure release valve 11 can be actuated electrically (not shown) rather than mechanically as in the case of the discussed embodiment, through a magnet switch or the like which will be operated by a second contact position of the microswitch 10 upon pressing the actuator 5.

Rigid connection of the adaptor to the carrying arm 15 of the housing 1 can be accomplished also in another way than that shown in the above-mentioned embodiment, for example, by thread engagement (not shown), so that the adaptor may be correspondingly threaded on to the carrying arm 15. Similarly to that, the outer wall of the discharging funnel 21 and the froth-creating housing 22 as well can be provided with threads (not shown) to thereby employ threaded engagement with one another.

The present arrangement functions as follows:

Upon pressing the actuator 5 the tapered surface of projection 8 moves the plunger 9 of the microswitch 10. When this takes place the electrical circuit between the battery 2 and motor 3 is closed via a not illustrated contact in the switch 10. The shaft of the motor 3 is connected with the air pump 4, which generates air pressure during rotation of the motor 3. The air pressure is transmitted through the conduit 12 into the passage 11*c* of the pressure release valve 11. As long as the passage 11 is open the air pressure discharges through the passage 11*a* into the interior of the housing 1. Eventually the pin 6, due to the following pressure exercized by a user on the actuator 5, sealingly enters through the opening 11*a* into the passage 11*a* of the valve 11. From now on and until the user releases the actuator 5, the air pressure runs through the passage 11*b* into the conduit 14*b* which communicates with this passage. From the conduit 14*b* of the carrying arm 15 the air pressure enters into the central air inlet passage 14*a* of the ball end pin 14 and further into the air passage 18*a* of the adaptor where the air pressure distributes partially into the spraying nozzle 19 and partially into the interior of the bottle 17. The liquid in the bottle 17 will run, under the applied pressure, through the tube 20 into the passage 18*b* and further through the circumferential channel (which is coaxial with the passage 18*c*) of the nozzle 19 and from there further in the radial passages (only two of them are shown in FIG. 1) to the passage 18*c*. From passage 18*c* the turbulent flow of liquid (due to the air flow running in passage 18*c*) is eventually sprayed out of the nozzle 19.

The passage 18*b* is open into the circumferential channel at an angle of 80°. Due to this fact, the liquid becomes turbulent and in such a condition the liquid enters uniformly into the radial passages distributed along the circumference of the passage 18*c*. Further intensification of the turbulence of the flow becomes possible due to the fact that the radial passages are located on the wedge-shaped portion of the adaptor. This portion has a pointed angle between 140° and 180°, and preferably 160°. The tip of the wedge is directed in the direction of the liquid flow. A ratio of the smallest unobstructed cross-sectional portion of the passage 18*c* to the smallest unobstructed cross-sectional portion of the circumferential channel for example in the case of using the arrangement for spraying hair lacquer is 1.5; for other cosmetic preparations this ratio is between 0.5 and 2.5.

The rate of flow of the liquid, for example in the case of hair lacquer, is 12 ml/min and if a foam or froth is desired to be obtained the rate of flow then is 60 ml/min.

The ball end pin 14, as shown in FIG. 1, is movably mounted in the carrying arm 15 for axial movement along this arm 15. The spring 13 urges the end pin 14 into engagement with the adaptor which is rigidly connected to the bottle 17. Due to such a connection, the adaptor may be located in a desirable position relative to the housing provided that the spring 13 insures the sealing contact of the adaptor and the conduit for supplying air. When the user ceases to press the actuator 5, the latter is forced by the spring 7 to move backwards to the initial (rest) position. Simultaneously with movement of the actuator backwards, the pin 6 also moves backwards thereby opening the passages 11*c* and 11*d* and allowing air flow through into the interior of the housing 1. Thus the air pressure in the interior of the bottle 17 fastly becomes even with the air pressure in the spraying nozzle 19. After the actuator 5 is completely released the electrical circuit of the motor 3 through the microswitch 10 is open and supply of the air pressure is over.

In another not shown embodiment, to decrease the weight of the arrangement the air pressure is created not by an electrically driven air pump but is supplied inside the arrangement from the outside thereof through additional flexible air pressure conduits.

It will be understood that each of the elements described above, or two or more together, may also find a useful application in other types of arrangements for spraying liquid from a bottle differing from the types described above.

While the invention has been illustrated and described as embodied in an arrangement for spraying liquid from a bottle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for arious applications without omitting features that, from the standpoint of prior art, fairly consitute essential characteristics of the generic or specific aspects of this invention.

What is claimed as new and desired to be protected by Letters Patent is set forth in the appended claims:

1. An arrangement for spraying liquid from a bottle, comprising an air pump; a housing for receiving said air pump; means for actuating said pump located in said housing and comprising a manually operable switch, a motor operatively connected with said switch on the one hand and said air pump on the other hand, said switch comprising a member movable between a resting position and a working position in response to force applied onto said member by a user, an end stop electrically connected with said motor and located in the path of movement of said member, so that when said member during its movement from said rest position displaces said end stop the latter actuates said motor, said member being provided with a projection having a lower tapered portion adjacent said end stop, so that when pressure applied from said projection onto said end stop upon displacement of said member from said resting position reaches a predetermined level said end stop actuates said motor, said actuating means comprising a pin fixedly mounted on said member; air inlet means for operatively connecting said pump with the interior of the bottle for supplying air into the bottle when said pump is actuated to thereby pressurize said liquid, said air inlet means comprising an air valve and means for operating said valve, said air valve having an inlet connected with said air pump, a first outlet connecting an interior of said valve with an interior of said housing, and a second outlet, said pin of said actuating means being directed towards said first outlet of the valve corresponding to and adapted to sealingly close said first outlet when said member moves from said resting position into said working position; an adaptor provided with said spraying means and adapted to fixedly mount said housing on the bottle, said adapter being provided with a first throughgoing passage connecting said air inlet means with the interior of the bottle, a spraying nozzle having one end open outwardly in direction away from said first passage and a second passage connecting said liquid outlet means with said spraying nozzle, said second outlet of said air valve of said air inlet means operatively connecting said interior of said valve with said first passage of said adaptor, said adaptor being further provided with a third passage operative for connecting said first passage with said spraying nozzle; liquid outlet means having a lower end extending into the liquid in the bottle and a discharge end outside the bottle; and means for spraying said liquid when said liquid under the pressure of the air supplied into the bottle enters the discharge end of the outlet means.

2. An arrangement as defined in claim 1, wherein said operating means further comprise first resilient means adapted to move said member back from said working position into said rest position when the user stops applying force on said member.

3. An arrangement as defined in claim 2, wherein said first resilient means comprise a first spring urging said pin out from said first outlet and said member back towards said rest position.

4. An arrangement as defined in claim 3, wherein said adaptor is replaceably received in said housing.

5. An arrangement as defined in claim 4, wherein said housing is further provided with means for rigidly connecting said air inlet means with said adapter so as to form an uninterrupted passage for air from said air valve to the interior of the bottle.

6. An arrangement as defined in claim 5, wherein said air inlet means comprise a conduit from said valve to said adaptor, said conduit being provided with an end portion having a ball end pin corresponding to and adapted to engage said first passage of the adaptor when the latter is installed on said housing.

7. An arrangement as defined in claim 6, wherein said air inlet means further comprise second resilient means urging said ball end pin sealingly downwardly into said first passage of the adaptor.

8. An arrangement as defined in claim 7, wherein said adaptor having an upper portion provided with an outwardly extended rim, said housing is being provided with an inwardly and radially elongated recess corresponding to and adapted to fixedly receive said rim to thereby define a bayonet lock with said adaptor.

9. An arrangement as defined in claim 8, wherein said bayonet lock is provided with means for insuring that the adaptor takes a predetermined position relative to the housing so that said nozzle of the adaptor facing outwardly in direction away from said housing.

10. An arrangement as defined in claim 9, wherein said nozzle is provided with an interchangeable discharging funnel.

11. An arrangement as defined is claim 10, wherein said funnel has a parabolic cross-section.

12. An arrangement as defined in claim 1, further comprising a separate hollow elongated barrel detachably mounted on said adaptor having a leading open end communicated with said nozzle and a trailing end open outwardly to the exterior of said barrel.

13. An arrangement as defined in claim 12, wherein said barrel is elastic.

14. An arrangement as defined in claim 13, wherein said barrel is inwardly provided with at least one partition longitudinally spaced from the outlet of said nozzle when said barrel is mounted on said adaptor.

15. An arrangement as defined in claim 14, wherein said barrel is inwardly provided with at least two partitions longitudinally spaced from each other and from the outlet of the nozzle when said barrel is mounted on said adaptor.

16. An arrangement as defined in claim 1, wherein said adaptor is further provided with a circumferential located outside of and substantially coaxial with said third passage, so that the second passage extending relative to the radius of the circumference of said channel at least at an angle of 30°.

17. An arrangement as defined in claim 16, wherein said second passage extends relative to the radius of the circumference of said channel at an angle of 80°.

18. An arrangement as defined in claim 17, wherein said adaptor is further provided with at least two radial passages operative for connecting said circumferential channel with said third passage.

19. An arrangement as defined in claim 18, wherein said adaptor is provided with four radial passages for connecting said circumferential channel with said third passage.

20. An arrangement as defined in claim 19, wherein said adaptor has a portion having a wedge-shaped cross-section, said portion being provided with said radial passages.

21. An arrangement as defined in claim 20, wherein said wedge-shaped portion has a pointed angle within a range of between 140° and 180°, the point of the angle facing in direction of the flow.

22. An arrangement as defined in claim 21, wherein said pointed angle is 160°.

23. An arrangement as defined in claim 22, wherein a range of the smallest unobstructed cross-sectional portion of the third passage to the smallest unobstructed cross-sectional portion of the circumferential channel is in a range of 0.5 and 2.0.

24. An arrangement as defined in claim 23, wherein said range is 1.5.

25. A hand-held system for spraying a variety of liquids, which system is designed to prevent contamination of any liquid being sprayed by residue remaining from a liquid which has previously been sprayed, comprising:

(a) a non-disposable element for delivery of compressed air, the non-disposable element including
  (1) a housing so shaped as to be graspable by a human hand,
  (2) an electric motor located within the housing,
  (3) an electrical power source located within the housing,
  (4) a switch located within the housing and being connected in series with the source and the motor whereby the motor is turned on when the switch is closed and turned off when the switch is opened,
  (5) an air pump located within the housing and connected to the motor to deliver compressed air when the motor is turned on,
  (6) an air coupling located on the housing for supplying compressed air outside the housing,
  (7) a pressure relief valve located within the housing and having an intake passage, an outlet passage and a ventable relief passage which ventable relief passage can be opened and closed,
  (8) a first air conduit located within the housing and connecting the air pump to the intake passage to enable compressed air to be delivered to the valve,
  (9) a second air conduit located within the housing and connecting the outlet passage to the coupling to enable compressed air to be delivered to the coupling,
  (10) controlling means located within the housing and movable back and forth to engage and disengage the ventable relief passage in a manner that the passage is closed when the controlling means is so engaged and in a manner that the passage is open when the controlling means is so disengaged,
  (11) a manually operable trigger member located in the housing in a manner that it is manually operable by a user, the trigger member having a resting position and a working position and cooperating with the controlling means and switch in a manner that the switch and relief passage are closed when the trigger is in the working position and the switch and passage are open when the trigger is in the rest position, and
  (12) a first mounting half located on the housing adjacent the air coupling for detachably connecting a disposable element thereto; and (b) a disposable element, the disposable element including
  (1) a hollow, open-topped bottle with an interior in which liquid can be stored,
  (2) an adaptor head located on top of the bottle, the adaptor head having a second mounting half cooperating with the first mounting half to detachably serve the adaptor to the housing, and further having a throughgoing intake passageway, the intake passageway being so located as to extend from the coupling into the interior of the bottle when the adaptor head is secured to the housing, whereby compressed air can be introduced into the interior of the bottle through the intake passageway when the adaptor head is secured to the housing, and still further having an outlet passageway, (3) a hollow, open-ended, vertically elongated riser tube extending upwardly from the interior of the bottle to the adaptor head, the tube being fixed to the adaptor head in a manner that the tube communicates with the outlet passageway, whereby liquid stored in the bottle can be forced into the riser tube and up into the outlet passageway when compressed air is introduced into the bottle, and (4) an integral spray head located in the adaptor head, the spray head having a nozzle and a network of nozzle passages located within the spray head in a manner that the nozzle communicates with the intake passageway and the outlet passageway via the nozzle passages, whereby the nozzle can receive compressed air from the intake passageway and liquid from the outlet passageway.

26. The system of claim 25 wherein the controlling means includes a pin fixed to the trigger member and directed towards the ventable relief passage.

* * * * *